US006375132B1

(12) United States Patent
Tomlinson

(10) Patent No.: US 6,375,132 B1
(45) Date of Patent: Apr. 23, 2002

(54) ELECTRIC IRON SAFETY STAND

(76) Inventor: Elaine N. Tomlinson, P.O. Box 16642, Tampa, FL (US) 33687

( * ) Notice: Subject to any disclaimer, the term of this patent is extended or adjusted under 35 U.S.C. 154(b) by 0 days.

(21) Appl. No.: 09/637,215

(22) Filed: Aug. 11, 2000

(51) Int. Cl.[7] ..... D06F 79/02

(52) U.S. Cl. ..... 248/117.6; 248/117.7; 248/231.71; 248/125.1

(58) Field of Search ..... 248/117.1, 117.2, 248/117.6, 117.7, 122.1, 125.1, 125.9, 133, 139, 140, 176.2, 231.71, 286.1, 292.13, 228.6, 124.1, 125.8, 229.15, 229.25, 117.3, 117.4

(56) References Cited

U.S. PATENT DOCUMENTS

| | | | | | |
|---|---|---|---|---|---|
| 155,202 | A | * | 9/1874 | Nutting | 248/454 |
| 1,110,190 | A | * | 9/1914 | Dodge | 248/117.7 |
| 2,251,592 | A | * | 8/1941 | Lowe | 248/286.1 |
| 2,508,974 | A | * | 5/1950 | Soditch et al. | 248/229.15 |
| 2,540,584 | A | * | 2/1951 | Jaycox | 248/515 |
| 2,697,776 | A | * | 12/1954 | Wale | 369/9 |
| 2,814,455 | A | * | 11/1957 | Rainey | 108/28 |
| 2,904,296 | A | * | 9/1959 | Graham | 248/117.7 |
| 2,914,829 | A | * | 12/1959 | Willemain | 248/229.15 |
| 3,317,171 | A | * | 5/1967 | Kramer | 248/229.15 |
| 3,426,990 | A | | 2/1969 | Pady | 248/117.6 |
| 3,508,732 | A | * | 4/1970 | Trachtenberg et al. | 248/237.71 |
| 3,770,234 | A | * | 11/1973 | Fovall | 249/3 |
| 3,891,173 | A | * | 6/1975 | Ellis et al. | 248/231.71 |
| 3,967,802 | A | | 7/1976 | Lomagno | 248/117.4 |
| 4,918,845 | A | | 4/1990 | Livecchi | 38/142 |
| 5,013,003 | A | | 5/1991 | Driessen et al. | 248/117.6 |
| 5,730,396 | A | * | 3/1998 | Fovall | 248/51 |
| 6,209,829 | B1 | * | 4/2001 | Yu | 248/122.1 |

* cited by examiner

*Primary Examiner*—Anita King
*Assistant Examiner*—Jon A Szumny
(74) *Attorney, Agent, or Firm*—Henderson & Sturm LLP

(57) ABSTRACT

A safety stand for an electric iron including a base attached to an ironing board by clamps. A support arm is pivotally attached to the base and is movable between and securable in one of a vertical working position and a lowered storage position. A C-shape grip with resilient fingers frictionally engages and secures the handle of an electric iron. The grip is vertically adjustable on the support arm by engagement of a threaded fastener extending from the grip through a slot in the support arm. Notches in the support arm are positioned to receive the electrical cord from the iron when the support arm is in the working position.

4 Claims, 1 Drawing Sheet

ELECTRIC IRON SAFETY STAND

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of household appliances, and more particularly to a safety stand for an electric iron.

2. Description of Related Art

As can be seen by reference to the following U.S. Pat. Nos. 3,426,990; 3,967,802; 4,918,845 and 5,013,003 the prior art shows diverse electric iron holders.

While all of the aforementioned prior art constructions are more than adequate for the basic purpose and function for which they have been specifically designed, they are uniformly deficient with respect to their failure to provide a simple, efficient, and practical safety stand for an electric iron that secures the iron in an upright position. This is to prevent the iron from falling off the board if it's dislodged inadvertently—something that could cause injury and damage the iron.

As a consequence of the foregoing situation, there has existed a longstanding need for a new and improved electric iron safety stand and the provision of such a construction is a stated objective of the present invention.

BRIEF SUMMARY OF THE INVENTION

Briefly stated, the present invention provides a safety stand for an electric iron including a base attached to an ironing board by clamps. A support arm is pivotally attached to the base and is movable between and securable in one of a vertical working position and a lowered storage position. A C-shape grip with resilient fingers frictionally engages and secures the handle of an electric iron. The grip is vertically adjustable on the support arm by engagement of a threaded fastener extending from the grip through a slot in the support arm. Notches in the support arm are positioned to receive the electrical cord from the iron when the support arm is in the working position.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
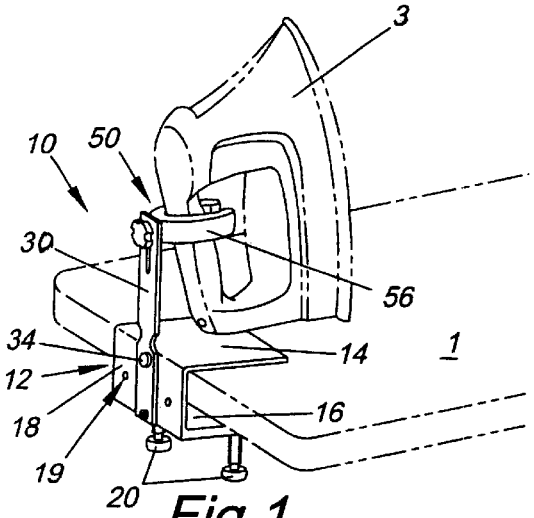
FIG. 1 is a perspective view of the electric iron safety stand of the present invention attached to an ironing board and securing an iron in an upright position.
Figure 2:
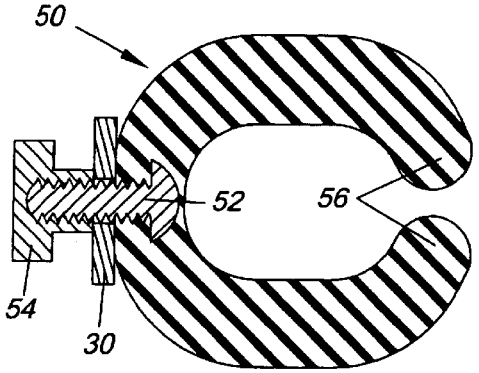
FIG. 2 is a sectional view taken along line 2—2 of FIG. 3.
Figure 3:
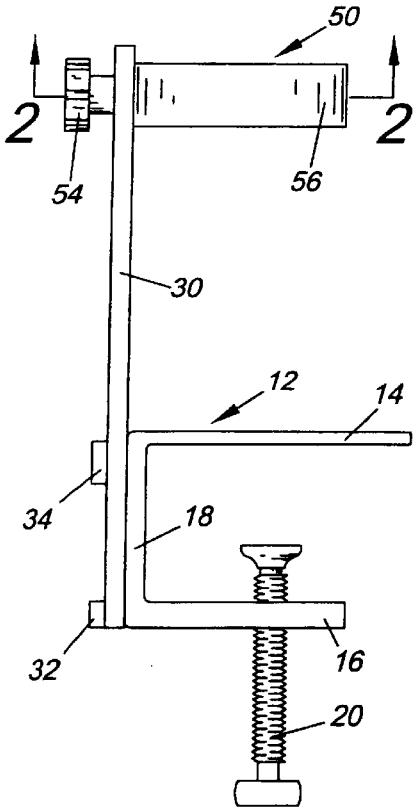
FIG. 3 is a side elevational view of the safety stand.

As can be seen by reference to the drawings, and in particularly to FIG. 1, the electric iron safety stand that forms the basis of the present invention is designated generally by the reference number 10. The safety stand 10 includes a base 12 having top and bottom spaced flanges 14, 16 interconnected by a web 18. A pair of threaded clamps 20 engage the bottom flange 16 and secure the base 12 to an edge of the ironing board 1.

Figure 4:
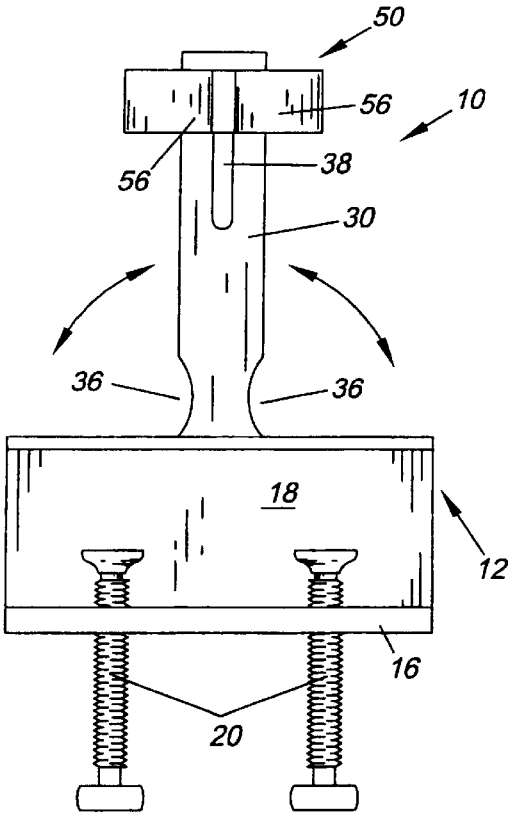
FIG. 4 is a front elevational view thereof.

A support arm 30 is pivotally attached to the web 18 by a shoulder bolt 32 and is movable between a vertical working position and a lowered storage position as indicated by the directional arrows in FIG. 4. The support arm 30 is secured in the selected one of the working and storage positions by engagement of a latching spring button 34 with recesses 19 in the web 18. The support arm 30 has a pair of notches 36 and an elongated slot 38.

A C-shaped grip 50 is adjustably attached to the support arm 30 by a carriage bolt 52 that extends from the grip 50 through the slot 38. A scalloped knob 54 is loosened to allow movement of the bolt 52 in the slot 38, and the knob 54 is tightened to secure the grip 50 in a selected position. The grip 50 has a pair of resilient opposing fingers 56 that frictionally engage and secure the handle of an electric iron 3.

In use, the safety stand 10 is secured to the ironing board 1 by the tightening of the screw clamps 20. With the support arm 30 in the vertical working position, the electric iron 3 is positioned in the grip 50 by positioning the handle at the ends of the fingers 56 and gently moving the handle from side-to-side while applying backward pressure. This process can be done by using one or both hands. Similarly, the iron 3 is released in reverse fashion by sliding it out of the grip 50. When in the working position, the notches 36 in the support arm 30 are disposed to receive the electrical cord (not shown) of the iron 3.

The safety stand may remain on the ironing board I thereby making it more convenient to use. When ironing is finished, the support arm 30 is pressed backward which releases the spring button 34 from the web recess 19 and allows the support arm 30 to be pivoted to either side (FIGS. 1 and 4) so that it is closer to the plane of the ironing board I and does not project excessively when the board is folded and put away. In addition, if the ironing board is left upright, the iron can remain secure in the C-grip 50 with the support arm 30 in the vertical position.

The grip 50 is vertically adjustable with respect to the top flange 14 of the base 12 by manipulation of the knob 54. This allows use of the safety stand 10 with irons 3 of different sizes and configurations. It is understood that means of vertical adjustment other than the slot 38 could be employed. It is noted that other designs exist that require the iron to be lifted high onto a hook feature attached to the end of the board or to place it in a depressed setting again attached off the end of the board. It is felt that these others require more expenditure of energy—making ironing more of a chore than necessary. In addition, if the iron face is kept in a horizontal plane it will continue to expel steam—something usually to be avoided.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A safety stand for an electric iron having a handle, the safety stand comprising:

a base including a pair of top and bottom horizontally disposed vertically spaced flanges and a vertically disposed web attached to and interconnecting the top and bottom flanges;

a pair of vertically disposed adjustable clamps threadably attached to the bottom flange;

a support arm pivotally attached to the web of the base and being movable between a vertical working position and a lowered storage position, wherein notches are formed in the support arm at a position aligned with the top flange when the support arm is in the working position;

a latch attached to the support arm and being disposed to selectively engage the web of the base to secure the support arm in a selected one of the working and storage positions; and a C-shaped grip attached to the support arm and including resilient opposing fingers disposed to frictionally engage and secure the handle of the electric iron; whereby other applications for this safety stand in particular the C-shaped grip are intended to be inclusive.

2. The safety stand of claim 1 wherein the grip is adjustably attached to the support arm.

3. The safety stand of claim 2 wherein an elongated closed slot is formed through the support arm, and wherein a threaded fastener extending from the grip adjustably engages the slot at a selected position, whereby vertical adjustment of the grip with respect to the top flange is provided.

4. A safety stand to secure and support in an upright position an electric iron having a handle to prevent the iron from being dislodged from an ironing board inadvertently, the safety stand comprising:

a base including a pair of top and bottom horizontally disposed vertically spaced flanges and a vertically disposed web attached to and interconnecting the top and bottom flanges, the composition of materials used giving the base necessary flexibility and durability, the width, length and thickness of various parts of the base being designed and constructed specifically to attach firmly to an ironing board and support the electric iron especially when a heel portion of the iron is resting on the base facilitating a form of tripod or 3-point contact;

a pair of vertically disposed adjustable clamps threadably attached to the bottom flange, the length and top portion of the clamps designed specifically to attach the base tightly to a contacting surface of the ironing board, including an underside;

a support arm pivotally attached to the web of the base, the construction being such as to aid in supporting an electric iron upright, the support arm being movable between a vertical working position and a lowered storage position, wherein notches are formed in the support arm at a position aligned with the top flange when the support arm is in the working position;

a self-contained latch attached to the support arm and being disposed to selectively engage the web of the base via recesses at specific positions allowing the arm to be secured in a selected one of the working or storage positions, the storage position allowing the grip to abut the ironing board and not project excessively when the ironing board is folded and not in use; and a resilient C-shaped grip attached to the support, arm and including opposing fingers, the resiliency thereof designed to frictionally engage the electric iron in an upright position via its handle in a sturdy fashion, as it performs in concert with the other components of this safety stand; whereby other applications for this safety stand, in particular the C-shaped grip intended to be inclusive.

* * * * *